United States Patent [19]

Itkis

[11] 4,455,025

[45] Jun. 19, 1984

[54] ELECTRONIC CARD AND BOARD GAME

[76] Inventor: Yuri Itkis, 5163 Darting Bird La., Columbia, Md. 21044

[21] Appl. No.: 301,118

[22] Filed: Sep. 11, 1981

[51] Int. Cl.[3] ..... A63F 3/06

[52] U.S. Cl. ..... 273/237; 273/269

[58] Field of Search ..... 273/237, 269; 434/201

[56] References Cited

U.S. PATENT DOCUMENTS

| | | | |
|---|---|---|---|
| 3,395,463 | 8/1968 | Worden | 273/237 |
| 4,221,571 | 9/1980 | Molat | 273/237 |
| 4,332,389 | 6/1982 | Loyd et al. | 273/237 |
| 4,365,810 | 12/1982 | Richardson | 273/269 |
| 4,378,940 | 4/1983 | Gluz et al. | 273/237 |

FOREIGN PATENT DOCUMENTS

| | | | |
|---|---|---|---|
| 2656024 | 6/1978 | Fed. Rep. of Germany | 273/138 A |
| 2059270 | 4/1981 | United Kingdom | 273/237 |

*Primary Examiner*—Richard C. Pinkham

*Assistant Examiner*—Leo P. Picard

*Attorney, Agent, or Firm*—Browdy and Neimark

[57] ABSTRACT

An electronic card and board game in which the players and/or leaders of the game are assisted by a microprocessor in the selection of random numbers for the game, and in monitoring the current status of the game as applicable to one or more playing cards bearing information relevant to the game. This information is presented in two distinct forms; the first form being convenient for human perception, and the second form being convenient for machine reading. The current status of the game is displayed upon a game board display shaped as a traditional game card, e.g. "Bingo" card. The display indicates the conditions of: a complete match, a partial match, or no match between the data read-in from a number of game cards and the data entered via a keyboard of the game board or a pseudo-random number generated.

16 Claims, 12 Drawing Figures

ELECTRONIC CARD AND BOARD GAME

BACKGROUND OF THE INVENTION

This invention relates generally to games and educational devices of various kinds and, in particular, to chance and skill, card and board electronic games having an objective of matching a known or unknown number, word, position, etc., e.g., "Bingo", mazes, puzzles, "war" games, and the like.

Heretofore, many electronic devices have been provided for playing a variety of chance and skill games with the help of prepunched cards bearing information relevant to the game. Some examples of this type of device are U.S. Pat. No. 3,734,507 Hillman et al., and U.S. Pat. No. 3,559,992 Kramer. However, these games apparata do not make use of state-of-the-art electronic technology, in particular, microprocessors.

Microprocessors are widely used in many electronic games including card and board games such as "Bridgemaster" disclosed in IEEE Spectrum, Vol. 17, No. 11, page 27. However, this apparatus is limited to a specific application and does not provide for selection of random numbers which are necessary for playing a variety of chance and skill games.

Other electronically controlled game devices including certain provisions for generating of pseudo-random data have been provided, e.g., the U.S. Pat. No. 3,653,026 Hurley but this type of device does not have means for reading game cards.

The very same deficiency, i.e., the inability to read-in any information from game cards seriously restricts application of many other state-of-the-art electronic games like the U.S. Pat. No. 4,240,638 Morrison, et al. This type of apparata can hardly be implemented as hand-held games.

SUMMARY OF THE INVENTION

The present invention is an electronic card and board game in which the players and/or leader of the game, e.g., "caller" in a "Bingo" game are assisted by a microprocessor in the selection of random numbers for the game, and in monitoring the current status of the game as applicable to one or more playing cards bearing information relevant to the game, e.g., the initial or final position in the game. Similar to computers and credit cards, this information is preferably presented in two distinct forms; the first form being convenient for human perception, and the second form being convenient for machine reading.

The game card is manually submitted for reading by a microprocessor controlled game board comprising: a data input means including a game card reading means, and a keyboard; data output means including a display means; and a central data processing means including a data storge means, an arithmetic and logic unit, and a pseudo-random data generating means responsive to the data input means.

The display means, having preferably a portion thereof shaped in the form of a traditional game card, e.g., "Bingo" card, indicates the conditions of: a complete match, a partial match, or no match at all between the data read-in from at least one game card on one side, and the data entered via keyboard or data generated by the pseudo-random data generator on the other side.

It is objective of the invention to provide an electronic card and board game which permits to play of a variety of chance and skill games, e.g., "Bingo", mazes, puzzles, and "war" games utilizing essentially the same game boards and a variety of game cards of a standardized form but having different informational content. In particular, in the case of "Bingo" and the like games, it is a further objective of the present invention to provide game apparatus assisting a participant of the game in conducting the following customary activities in the course of the game:

a. selection of random numbers and patterns to be followed in the game;
b. monitoring the current status of the game as applicable to one or more game cards;
c. verification of the winning card.

Other objects and features will become apparent with a further reading of the specification.

DESCRIPTION OF THE PREFERRED EMBODIMENT

Figure 1:
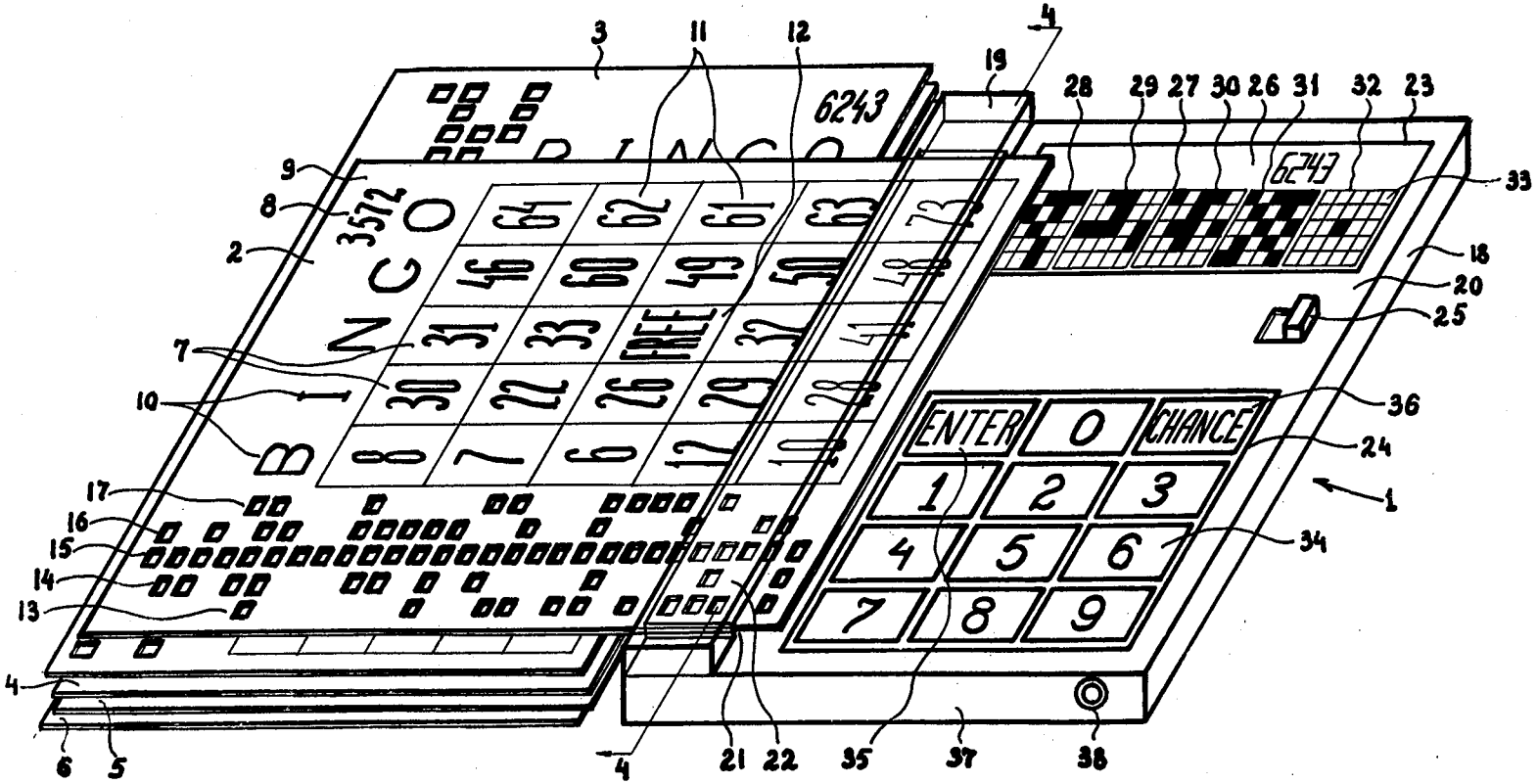
FIG. 1 is a perspective view of the game board and game cards.

The perspective view of the preferred embodiment of the card and board game is presented in FIG. 1 wherein 1 is the game board, and 2, 3, 4, 5, and 6 are "Bingo" cards for playing a "Bingo" game with the assistance of the game board 1.

Similarly to usual "Bingo" cards, each of the "Bingo" cards 2, 3, 4, 5, and 6 has 24 "Bingo" numbers 7, and an identification number (ID) 8 printed upon its face surface 9. The "Bingo" numbers 7 are arranged in the usual five vertical columns "BINGO" 10 and five horizontal rows 11 with the "FREE" central cell 12. But unlike standard "Bingo" cards, each of the cards 2, 3, 4, 5, and 6 has also five vertical columns of perforations 13, 14, 15, 16, and 17, each of said perforations being of identical dimension and form. Whereas the perforations in the central column 15 are equally spaced vertically, the perforations in columns 13, 14, 16, and 17 are generally not. Each of the four columns 13, 14, 16, and 17 has fewer perforations than the central column 15; and each individual perforation that does appear in any of the column 13, 14, 16, and 17 is alligned vertically with one of the perforations in the central column 15. Collectively, the five vertical columns of perforations 13, 14, 15, 16, and 17 provide a binary representation of the information printed upon the surface 9 of the "Bingo" card 2 including the "Bingo" numbers 7 and ID 8. Specifically, each horizontal row of perforations represents a 4-bit binary number (nibble), since the central column 15 is only a reference column and does not convey any data. Neither of the rows of perforations contains all the five perforations, i.e., the coding technique excludes the hexadecimal number "F" as illegal, all other hexadecimal numbers "zero" through "E" are allowed.

The game board 1 is enclosed in a case 18 of regular rectangular forms with " "-shaped transparent bracket 19 securely attached (glued) to the case 18 at the left corners of the face (horizontal) surface 20 of the case 18.

The bracket 19 forms a through slot 21 between the face surface 20 and the horizontal portion 22 of the " "-bracket 19. The "Bingo" card 2 can be freely moved (pushed and/or pulled) through the slot 21, but the inner dimensions of the slot 21 closely approximate the outer dimensions of the card 2.

The case 18 also accommodates a dot-matrix Liquid Crystal Display (LCD) 23, a membrane keyboard 24, and an ON-OFF switch 25 on its face surface 20. The display 23 is subdivided into the upper alphanumerical portion 26, and the lower graphics portion 27. The graphics portion 27 incorporates five reserved rectangular areas 28, 29, 30, 31, and 32; each of these areas are again subdivided into twenty-five identical rectangular cells 33 arranged in five columns and five rows. The keyboard 24 incorporates twelve keys: ten numerical keys "zero" through "nine" 34, and two functional keys "ENTER" 35, and "CHANCE" 36.

Figure 2:
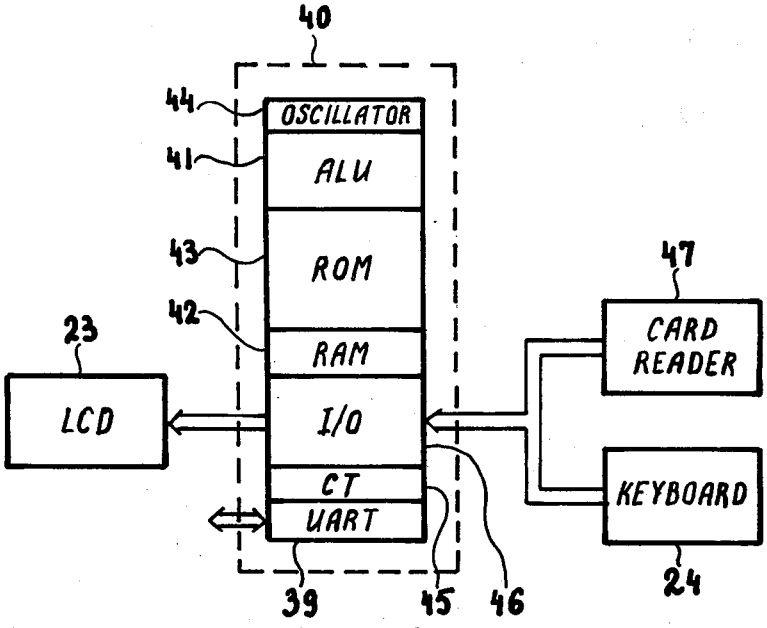
FIG. 2 is a block-diagram of the game board.

The front vertical wall 37 of the case 18 accommodates an outlet jack 38 of a Universal Asynchronous Receiver Transmitter (UART) 39, the latter being an integral portion of the single-chip micro computer unit (MCU) 40 confined within the game board 1 under its case 18 and presented in the block diagram in FIG. 2. In addition to the UART 39, the MCU 40 also incorporates an Arithmetic and Logic Unit (ALU) 41, a Random Access Memory (RAM) 42, a Read Only Memory (ROM) 43, an oscillator 44, a Counter-Timer (CT) 45, and an Input-Output Controller (I/O) 46. The I/O 46 controls the LCD 23 and accepts input signals from a card reader 47, and the keyboard 24. The input and output lines of the UART 39 terminate at the jack 38.

Figure 3:
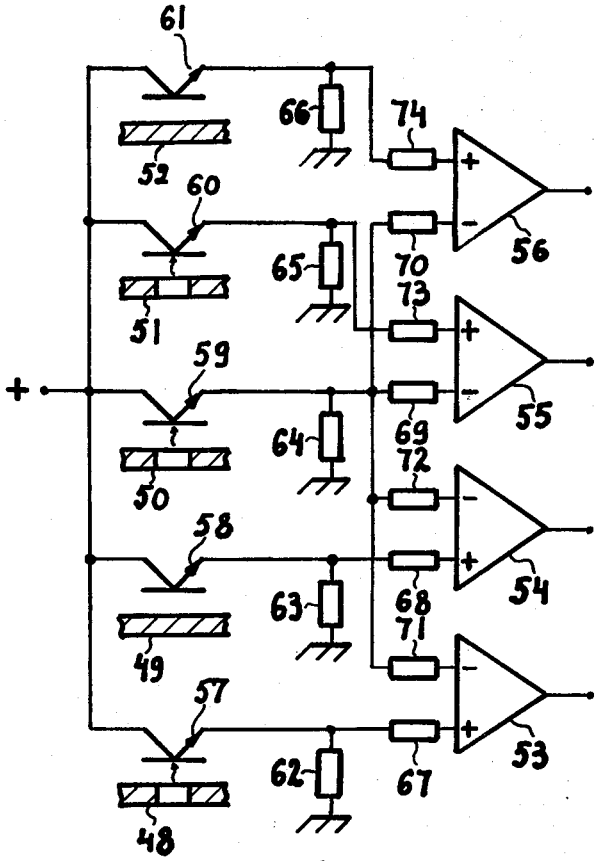
FIG. 3 is an electrical diagram of the card reader.

The block diagram of the card reader 47 is shown in FIG. 3 wherein 48, 49, 50, 51, and 52 are symbols denoting a cross section of a portion of the game card 2; 53, 54, 55, and 56 are Complementary Metal-Oxide-Semiconductor (CMOS) comparators; 57, 58, 59, 60, and 61 are phototransistors, and 62 through 74 are resistors. The collectors of all the five phototransistors 57, 58, 59, 60, and 61 are at a positive potential while their emitters are connected to respective load resistors 62, 63, 64, 65, and 66 of identical value. The centrally positioned phototransistor 59 provides a reference bias to all four comparators 53, 54, 55, and 56 via identical resistors 69, 70, 71, and 72 connected to respective negative inputs of these comparators. The other four phototransistors 57, 58, 60, and 61 provide the data signals to the respective comparators 53, 54, 55, and 56 through the respective identical resistors 67, 68, 73, and 74 connected to the positive inputs of these comparators. Each of the resistors 69, 70, 71, and 72 is of a higher value than its respective counterpart resistor 67, 68, 73, and 74.

Figure 4:
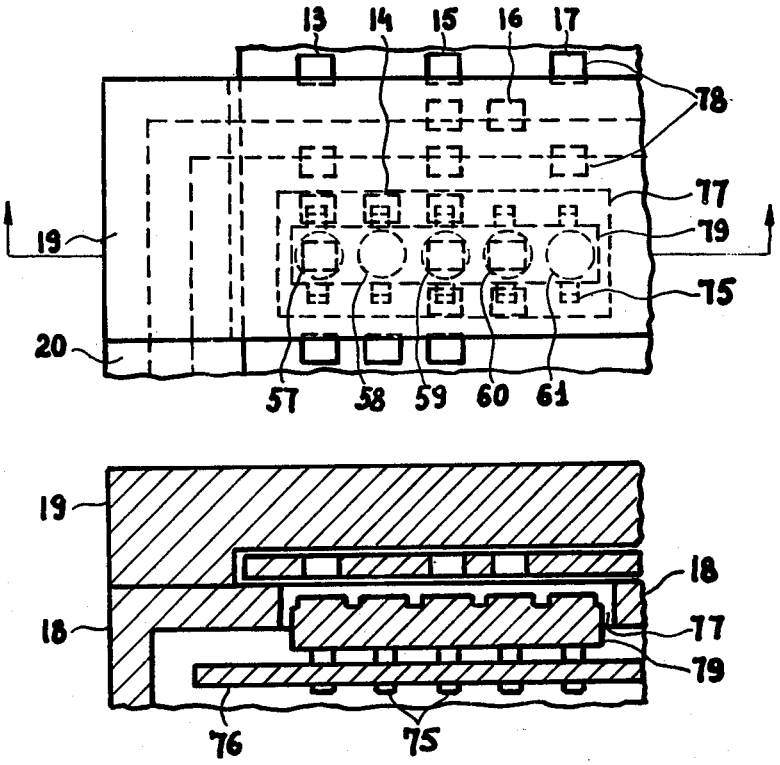
FIG. 4 is an enlarged sectional view on the line 4—4 of FIG. 1

Mechanically, all the five phototransistors 57, 58, 59, 60, and 61 are integrated in a single Dual-in-Line Package (DIP) 79 which is shown along with a number of other elements of the game board in FIG. 4 in two orthogonal projections, namely; a partial top view and a partial sectional front view. The pins 75 of the DIP 79 are soldered to a Printed Circuit Board (PCB) 76, and the body of the DIP 79 is positioned within a rectangular opening 77 in the upper surface 20 of the case 18 so that all the phototransistors 57, 58, 59, 60, and 61 are exposed to external light if no "Bingo" card is inserted in the slot 21. In the specific example of FIG. 4, the phototransistors 57, 59, and 60 are exposed to the external light through the transparent bracket 19, and the perforations 78 in the columns of perforations 13, 15, and 16 in the "Bingo" card 2. The other two phototransistors shown in FIG. 4, namely; 58, and 61 are in the shadow of the card 2.

In the process of playing a "Bingo" game, a user of the game board 1 manually moves at least one of the "Bingo" cards 2, 3, 4, 5, and 6 through the slot 21 and by doing so enables machine reading of the information coded into columns of perforations 13, 14, 16, and 17.

Depending upon the current position of the card 2 in the slot 21, the following three alternatives are possible: none of the phototransistors 57 through 61 is exposed to light; some of the phototransistors are exposed to light while others are not; and finally, all the phototransistors are exposed to light. In the first and last cases, the signals arriving at the positive inputs of the comparators 53, 54, 55, and 56 are equal to the signals arriving to their respective negative inputs, but since the resistors 69, 70, 71, and 72 are of a higher value than the resistors 67, 68, 73, and 74, in both cases the outputs of all the comparators 53 through 56 are at the "high" logic level, i.e., represent the hexadecimal number "F". Since this hexadecimal number is not employed for coding of the information imprinted on the card 2, the MCU 40 treats this number as a delimiter in the stream of data read by the card reader 47.

In the case when the reference phototransistor 59 is exposed to light while at least one of the data phototransistors 57, 58, 60, and 61 is not, one or more of the comparators 53, 54, 55, and 56 are switched to the "low" logic level, since the value of resistors 69, 70, 71, and 72 is only slightly higher than the value of resistors 67, 68, 73, and 74, and consequently, the signal developed by the reference phototransistor 59 prevails upon the "dark current" signal being developed by any of the data phototransistors 57, 58, 60, and 61 which are not exposed to light. For example, in the case shown in FIGS. 3 and 4, the phototransistors 57, 59, and 60 are exposed to light while the phototransistors 58 and 61 are not. Consequently, the outputs of the comparators 53 and 55 are at the "high" logic level while the outputs of the comparators 54 and 56 are at the "low" logic level, i.e., the card reader 47 reads hexadecimal number "A".

Figure 5:
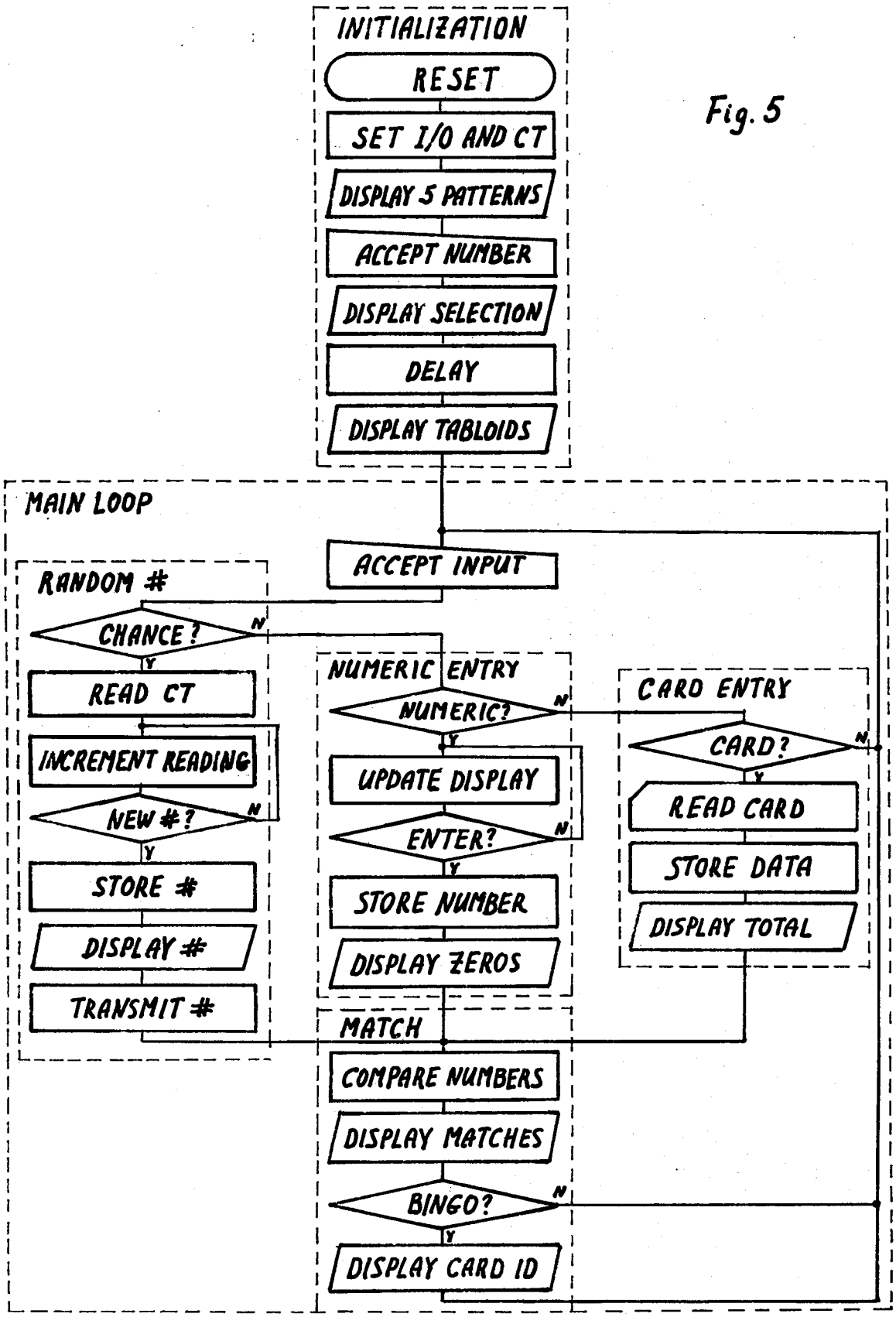
FIG. 5 is a flow chart of the operations of the game board.

The flowchart in FIG. 5 provides an insight into the main operations of the game board 1. The flowchart consists of two major portions, namely: the Initialization followed by the Main Loop. The Initialization starts with Reset and continues through consecutive subroutines: Set I/O and CT, Display Patterns, Accept Number, Display Selected Pattern, and Delay. The Main Loop starts with the subroutine Accept Input and then, depending upon the type of the input signal, splits into three parallel branches: Random #, Numeric Entry, and Card Entry. The first, Random #, branch starts from the logical decision block Chance?, and goes through sequential subroutines: Read CT, Increment Reading, New #?, Store #, Display #, and Transmit #. The second, Numeric Entry, branch starts from the decision block Numeric? and goes through sequential subroutines: Update Display, Enter?, Store Number, and Display Zeros. The third branch, Card Entry, starts from the logical decision block Card? followed by subroutines Read Card, Store Data, and Display Total. All the three branches merge together at the entry point to the last task of the Main Loop, namely, Match. The Match task involves four sequential subroutines: Compare Numbers, Bingo', and Display Card ID.

The MCU 40 automatically executes Reset upon switching of the ON-OFF switch 25 and then starts execution of the instructions stored in ROM 43. First of all, the subroutine Set I/O and CT is executed resulting in setting-up of all I/O, and preloading and starting of CT 45. The CT 45 is preset to the count of seventy four and is decremented at each clock pulse generated by the oscillator 44. Upon achieving the zero count, the CT 45 is automatically reloaded to the initial count of 74 and the process of counting down is repeated.

Figure 6:
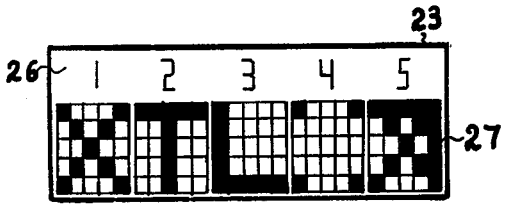
FIG. 6 through 12 are top views of the game board's display in seven consecutive stages of the game.

The subroutine Set I/O and CT is followed by execution of the subroutine Display Patterns resulting in displaying of five standard "Bingo" patterns upon the display 23. These patterns presented in FIG. 6 include: "X", "T", "L", "Four Corners", and "Column/Row/-Diagonal". Each of these patterns is accompanied by a respective identification number, one through five, shown immediately above the pattern in the alphanumerical portion 26 of the display 23. Each pattern is formed as a mosaic of black and white rectangular cells and all the dots within any single cell are either simultaneously activated (black cells) or deactivated (white cells).

Figure 7:
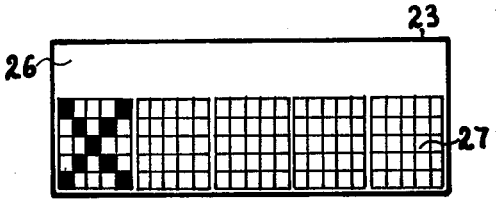
Figure 8:
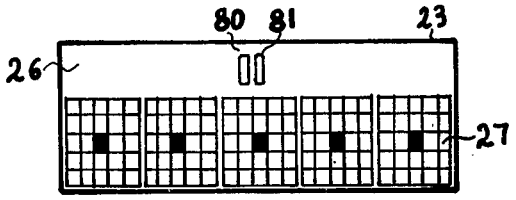

Upon completion of the subroutine Display Patterns, the MCU 40 starts to poll the keyboard 24 waiting for a numerical entry in the range of one to five. The MCU debounces and validates each and every entry (subroutine Accept Numbers), and upon successful acceptance of a valid keyboard entry, clears out all the alphanumerical and graphics information but the selected pattern from the display 23 (subroutine Display Selection) as it is shown in FIG. 7. The selected pattern is displayed during a predetermined time interval on the order of seveval seconds (subroutine Delay), and the user has the opportunity to recognize the selected pattern and restart the game (by switching the ON-OFF switch 25 first off and then on again) if a wrong pattern identification was mistakenly entered initially. After this interval elapses, the display 23 is updated again (subroutine Display Tabloids), this time showing the picture presented in FIG. 8, namely: five empty "Bingo" tabloids with a single black cell in the center of each of the tabloids emulating the "FREE" cell 12, and two zeroes in two single-digit data fields 80 and 81 positioned in the center of the alphanumerical portion 26 of the display 23. The picture indicates to the user that preparations for the game are completed; and the MCU 40 resumes polling of the inputs. This time it includes both the keyboard 24, and the card reader 47.

Figure 9:
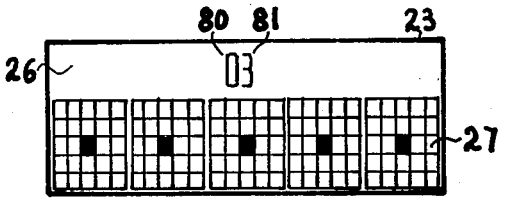
Figure 10:
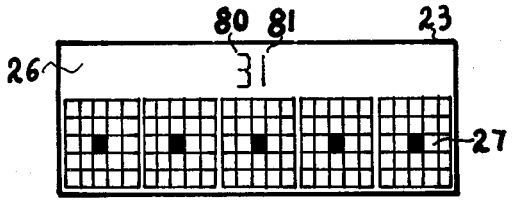

The input signals are debounced and validated (subroutine Accept Input) and sorted out into three types for subsequent processing: the "CHANCE" key 36 entry identified by the logical decision block Chance ?, the numerical entry from the keyboard 24 identified by the logical decision block Numeric?, and the card reader 47 signal identified by the logical decision block Card?. If the input signal comes from a numerical key 34, the two single-digit data fields 80 and 81 are updated by the subroutine Update Display, specifically, the newest entry is displayed in the right data field whereas the digit previously displayed in the field 81 is shifted into the left single-digit data field 80. The process of updating of the right data field 81 with a newly entered number and shifting the previous one into the left data field is repeated upon each successive numerical key entry, so that the user of the game board 1 can easily change numbers displayed in the data fields 80 and 81 to any desired number, in particular, to a "Bingo" number announced by the "caller". The process of updating the display 23 is illustrated in FIG. 9 and 10 showing the current status of the display 23 upon two successive numeric key entries, specifically, the entry "three" followed by the entry "one".

Figure 11:
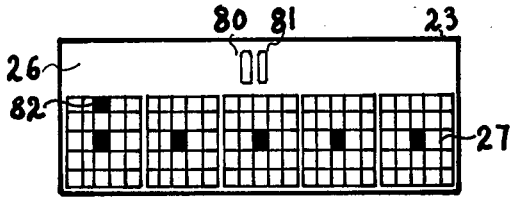

As soon as the "ENTER" key 35 is pressed, logical decision block Enter? identifying this entry prevents further updating of the display 23 and transfers control to the subroutine Store Number which stores the latest two-digit number displayed in the data fields 80 and 81 in the RAM 42. Next, the subroutine Display Zeros zeros both data fields 80 and 81 but does not affect the graphics portion 27 of the display 23 preserving its previous status as it is shown in FIG. 11. This ends up the Numerical Entry branch.

The Card Entry branch is initiated by a successful Card? test. Once invoked, this branch is not finished until all the data coded in the columns of perforations 13, 14, 16, and 17 of a single "Bingo" card, say the card 2, is read by the card reader 47 controlled by the subroutine Read Card (consequently, the keyboard 24 is disabled during the card reading process). All the data read from the card 2 is preserved by the subroutine Store Data in RAM 42. The user of the game board 1 is notified about a successful completion of the reading process by the subroutine Display Total which displays zero in the left data field 80 and the total number of cards read so far in the right data field 81; the graphics portion of the display remains unchanged.

The Random # branch is invoked by a successful "CHANCE" key 36 test Chance? which is followed by the subroutine Read CT that reads the current count of CT 45. Since the clock frequency is on the order of hundreds of kilocycles at least, the current reading of CT 45 cannot be controlled by the user whose physical reaction time is on the order of 1 to 0.5 seconds at best. Therefore, the current reading of CT 45 is a pseudo-random number. The current reading of CT 45 is incremented by the subroutine Increment Reading, i.e., the range of CT counts: zero to seventy four is shifted to the traditional range of "Bingo" numbers: one to seventy five. Then the subroutine New # tests whether the resulting shifted pseudo-random number is new, i.e., was not previously generated in the course of the game. If the number is already stored in the RAM 42, the number is incremented again, and so on until a truly new pseudo-random number is generated. The finally selected pseudo-random number is preserved in RAM 42 for future reference by the subroutine Store #; it is also transmitted by the UART 39 controlled by the subroutine Transmit #.

The generated pseudo-random numbers are stored together with the numbers directly entered via keyboard 24 in the same area in RAM 42, and in the order they were entered or generated, without any regard to their origin. MCU 40 treates all the numbers stored in this area identically; therefore, they all collectively as a group may be called "board numbers", without specific reference to their external or internal origin.

Figure 12:
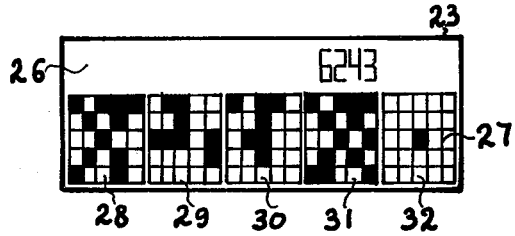

As soon as either of the three alternative branches Random #, Numeric Entry, and Card Entry is finished, the MCU 40 executes the subroutine Compare Numbers which compares all the "Bingo" numbers 7 from the "Bingo" cards 2, 3, 4, 5, and 6 with all the board numbers entered via the keyboard 24 and/or pseudo-random "Bingo" numbers generated internally by the current time. Any and all matches between the "board numbers" and the "Bingo" numbers 7 are displayed by the subroutine Display Matches in the reserved areas 28, 29, 30, 31, and 32 of the display 23 as it is illustrated in FIG. 12. The individual reserved areas 28, 29, 30, 31, and 32 are assigned to the "Bingo" cards 2, 3, 4, 5, and 6 in the order of reading the cards, i.e., the status of the first read card 6 is shown in the area 28, and the status of the last read card 2 is shown in the area 32. Each and every match between the "board numbers" and "Bingo" numbers 7 is indicated in the reserved areas 28, 29, 30, 31, and 32 as a black cell in the same row and column as the respective "Bingo" number 7 occupies on the respective "Bingo" card 6, 5, 4, 3, and 2, e.g. if number "31" happens to be such a match, then a corresponding cell 82 is indicated as it is shown in FIG. 11.

Following the subroutine Display Matches the logical decision block Bingo? checks the patterns of matches indicated in the areas 28, 29, 30, 31, and 31 against the selected pattern identified by the subroutine Display Selections (shown in FIG. 7). Should any of the patterns in the areas 28, 29, 30, 31, and 32 completely cover the selected pattern, the "Bingo" status is achieved, and the MCU 40 executes the subroutine Display Card ID which displays the ID 8 of the respective "Bingo" card 2, 3, 4, 5, and 6 above the respected reserved areas 28, 29, 30, 31, and 32 (see FIG. 12). Whether "Bingo" is identified or not, the MCU 40 resumes execution of the Accept Input subroutine either immediately after the test Bingo? or after displaying the ID 8 of the Winning "Bingo" card 3.

The flowchart presented in FIG. 5 allows a substantial flexibility in playing the "Bingo" game for the "caller" and the regular player. For example, the player is advised to present all of his/her "Bingo" cards to the game board 1 at the very beginning of the game and then just enter new "Bingo" numbers via the keyboard 24 as they are announced by the "caller", and watch the status of the game on the display 23. The "caller" is advised to use the game board 1 as a pseudo-random number generator throughout the game, and only at the end of the game, when a player announces a "Bingo", to verify the validity of the "Bingo" claim by means of submitting the claimed card to the game board 1 for reading and verification. A mixed strategy of playing can be used, in which players themselves generate pseudo-random numbers in turns and collectively verify winning card or cards.

While a specific embodiment of the invention has been shown and described in detail to illustrate the application of the invention principles, it is understood that the invention may be embodied otherwise without departing from such principles.

For example, the capacity of the display 23 and the RAM 42 could be changed to allow for playing of more or less than five "Bingo" cards and/or patterns at once. Or the display 23 could be timeshared for displaying the status of several "Bingo" cards in the same reserved area (ultimately only one "Bingo"-shaped tabloid could be used for indicating the current status of all the "Bingo" cards read by the game board). The status of all the "Bingo" cards sharing the same reserved area could be shown sequentially (rolled over) so that the image of each card occupies the display during a predetermined amount of time; or a time allocation could be prioritized in such a way that the cards more likely to win (e.g., having more matches) are displayed more frequently or during longer time intervals. Provided the display 23 is of sufficient capacity, "Bingo" numbers 7 could be directly displayed in respective positions of the reserved areas 28, 29, 30, 31, and 32, i.e., the cells shown as empty in FIG. 6 through 12 could be occupied with "Bingo" numbers 7 read from the respective "Bingo" cards 2 through 6.

A variety of physical implementations of the display are conceivable. For example, a number of individual displays showing the card ID could be incorporated. Also, the physical nature of the display may be changed, e.g., Light Emitting Diodes (LED), Plasma Displays, and/or Cathode Ray Tubes could be implemented.

The design of the keyboard 24 may be changed. In particular, some keys may be eliminated or more functional keys may be added, including keys allowing mathematical operations useful for computing the chances to win and the size of the "Jack Pot", etc. The design of electronics circuitry may be changed, e.g., instead of a single-chip microcomputer, a printed circuit board incorporating a number of integrated circuits may be used.

A variety of different implementations of card readers is conceivable. In particular, an active card reader utilizing internal sources of light, e.g., matched photodiode-phototransistor couples can easily be implemented.

Also, a variety of techniques for conveying the data from the game cards to the game board could be provided. For example, imperforated cards having electrically or magnetically conductive areas and means for transmitting a signal to and accepting a signal by the game board could be implemeted. Even more, a game board could be provided with a means of optical scanning of the regular characters and symbols printed upon the game card, thus eliminating the need for separate machine readable information on the game card.

The imput means of the game board could also be expanded to include sound and/or voice communication features such as a tone generator, a speech synthesizer, a loudspeaker, a speech digitizer and so on. This expansion of I/O means would greatly facilitate the process of playing a variety of chance and skill games. For example, if the game board is provided with a tone generator and the keyboard bears Braille insignia upon it, then a blind person could use the game board for playing a variety of games including "Bingo". In addition, a number of game boards could be combined in a communication network by means of interconnecting the UARTs of several game boards, e.g., the data entered into and/or generated in one game board could be automatically entered into a number of other game boards participating in the network.

Although the invention has been illustrated and described as a "Bingo" game, a large number of other applications is contemplated. For example, a variety of puzzles, mazes, and educational problems printed upon cards which also bear scrambled answers to the game or problems in a machine readable form can be played awith the help of essentially the same game board; only the ROM has to be reprogrammed or a plug-in ROM can be used, and perhaps, the keyboard has to be relabeled or a replaceable label mask can be used.

It will be obvious to those skilled in the art that various changes may be made without departing from the scope of the invention and the invention is not to be considered limited to what is shown in the drawings and described in the specification.

What is claimed is:

1. An electronic game board comprising a data input means including a keyboard and a remote data entry means, a data processing means including a data storage, a data output means including a display, and data transmission means;

said data processing means being responsive to said data input means and storing in said data storage bingo card numbers and a bingo pattern being played;

said data output means being controlled by said data processing means and signaling the current status of a bingo game;

said data input means inputting commands and data including called bingo numbers;

said called bingo numbers being independent of said bingo card numbers and said bingo pattern;

said status being determined by said data processing means as a result of a mutual comparison of said called bingo numbers with said bingo card numbers and with said bingo pattern;

in combination with at least one tangible bingo card being played with the help of said electronic bingo game board; and said tangible bingo card bearing identification numbers and bingo numbers identical to said bingo card numbers stored in said data storage; and communication channel means operatively interconnecting remotely located means to said remote data entry means to deliver at least a portion of said commands and data from said remotely located means to said electronic game board via said remote data entry means.

2. The combination of claim 1, wherein said data input means, said data processing means, and said data output means cooperatively provide a user of said electronic bingo game board with a means for correcting the latest erroneously entered data including said called bingo numbers while preserving all the previously entered data.

3. The combination of claim 1, wherein said display, continuously displays as many bingo card shaped tabloids as there are bingo cards being played with the help of said electronic bingo game board; and said tabloids indicating matches between said called bingo numbers and said bingo card numbers.

4. The combination of claim 1, wherein said bingo card numbers and said bingo pattern stored in said data storage are derived by said data processing means as a result of processing of said commands and data entered via said data input means excluding said called bingo numbers.

5. The combination of claim 1, wherein said commands and data inputted via said data input means include at least one of said identification numbers.

6. The combination of claim 1, wherein said data input means include a means for reading of said tangible bingo cards.

7. The combination of claim 1, wherein said tangible bingo cards bear two equivalent sets of said identification numbers and said bingo numbers; the first set presented in a form convinient for human perception and the second set presented in a form convinient for machine reading.

8. The combination of claim 1, wherein said electronic bingo game board has a means for aligning and retaining said tangible bingo card in a proper working position.

9. The combination of claim 8, wherein said tangible bingo card overlays said diplay while being in said working position.

10. The combination of claim 1, wherein said data processing means include a means generating pseudo random bingo numbers; each of said pseudo random bingo numbers being generated separately in response to a command entered via said data input means, and is being used in lieu of one of said called bingo numbers, and is displayed, and transmitted.

11. The combination of claim 1, wherein said tangible bingo card is at least partially transparent and exibits said bingo numbers and said identification numbers.

12. The combination of claim 11, wherein said bingo card overlays said display while in said working position

13. The combination of claim 1 wherein said remotely located means comprises another said electronic game board functioning as a dealer's game board.

14. In combination, a predetermined set of bingo cards, and an electronic bingo game board for playing at least one bingo card out of said predetermined set; said electronic bingo game board comprising:

a data input means including a keyboard, a bingo card reader, and a remote data entry means, a data processing means including a storage means and a pseudo random bingo numbers generating means, and a data output means including a display means and a data transmission means;

said data processing means being responsive to said data input means and controlling said data output means based upon a number of factors relevant to a bingo game being played including results of comparisons between:

bingo card numbers in said at least one bingo card, and called bingo numbers, and a bingo pattern being played; said data input means entering data identifying said bingo game including:

said bingo pattern, and said called bingo numbers and commands to generate pseudo random bingo numbers in lieu of said called bingo numbers, and an alphanumerial identification number of said at least one bingo card and said bingo card numbers; said data output means displaying and transmitting the information relevant to said bingo game including:

a game completion message if a bingo is achieved, and an indication of the matches between said bingo card numbers and said called bingo numbers, and data entered via said data input means; and communication channel means operatively interconnecting remotely located means to said remote data entry means to deliver at least a portion of said data identifying said bingo game from said remotely located means to said electronic game board via said remote data entry means.

15. The combination of claim 14, in which said data processing means stores and computes said bingo card numbers utilizing said pseudo random bingo numbers generating means including said keyboard.

16. The combination of claim 14 wherein said remotely located means comprises another said electronics game board functioning as a dealer 's game board.

* * * * *

US004455025C1

(12) REEXAMINATION CERTIFICATE (4748th)

United States Patent

Itkis

(10) Number: US 4,455,025 C1

(45) Certificate Issued: Mar. 11, 2003

(54) ELECTRONIC CARD GAME AND BOARD GAME

(75) Inventor: Yuri Itkis, Columbia, MD (US)

(73) Assignee: Fortunet Inc., Las Vegas, NV (US)

Reexamination Request:
No. 90/003,991, Oct. 5, 1995

Reexamination Certificate for:

| | |
|---|---|
| Patent No.: | **4,455,025** |
| Issued: | **Jun. 19, 1984** |
| Appl. No.: | **06/301,118** |
| Filed: | **Sep. 11, 1981 06/301,118** |

(51) Int. Cl.[7] ..... A63F 3/06

(52) U.S. Cl. ..... 273/237; 273/269

(56) References Cited

U.S. PATENT DOCUMENTS

| | | | | |
|---|---|---|---|---|
| 2,760,619 A | * | 8/1956 | Peak | |
| 3,671,041 A | | 6/1972 | Taylor et al. | 273/135 A |
| 4,093,215 A | | 6/1978 | Ballard | 273/1 E |
| 4,254,404 A | | 3/1981 | White | 340/311 |
| 4,312,511 A | * | 1/1982 | Julien | |
| 4,332,389 A | | 6/1982 | Loyd et al. | 273/237 |
| 4,339,798 A | | 7/1982 | Hedges et al. | 364/412 |
| 4,373,726 A | | 2/1983 | Churchill et al. | 273/138 |
| 4,378,940 A | | 4/1983 | Gluz et al. | 273/237 |
| 4,624,462 A | | 11/1986 | Itkis | 273/237 |

OTHER PUBLICATIONS

PLATO Computer Bingo System Materials (1976–1980). Courseware Agreement between the Board of Trustees of the University of Illinois and Control Data Corp (CDC), 1976.*

* cited by examiner

*Primary Examiner*—Stephen Marcus

(57) ABSTRACT

An electronic card and board game in which the players and/or leaders of the game are assisted by a microprocessor in the selection of random numbers for the game, and in monitoring the current status of the game as applicable to one or more playing cards bearing information relevant to the game. This information is presented in two distinct forms; the first form being convenient for human perception, and the second form being convenient for machine reading. The current status of the game is displayed upon a game board display shaped as a traditional game card, e.g. "Bingo" card. The display indicates the conditions of: a complete match, a partial match, or no match between the data read-in from a number of game cards and the data entered via a keyboard of the game board or a pseudo-random number generated.

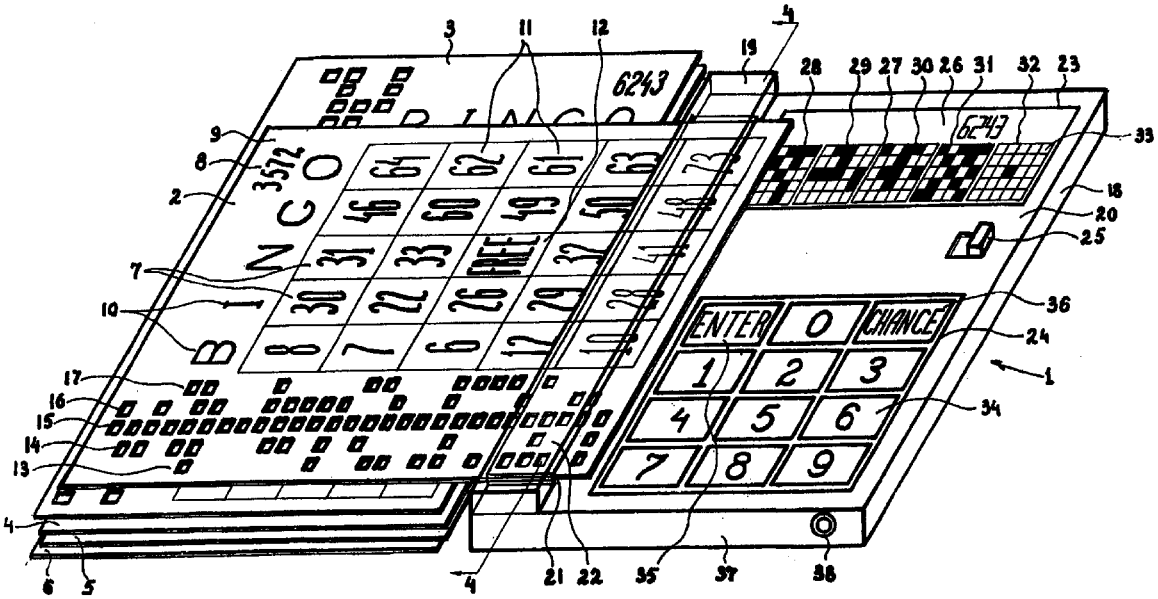

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9, 11, 12, 13 and 16 is confirmed.

Claims 1–8, 10, 14 and 15 are cancelled.

* * * * *